US008398082B2

(12) United States Patent
Cabrera

(10) Patent No.: US 8,398,082 B2
(45) Date of Patent: Mar. 19, 2013

(54) LINKING PUZZLE GAME AND METHOD

(76) Inventor: Jose Manuel Cabrera, Miami, FL (US)

( * ) Notice: Subject to any disclaimer, the term of this patent is extended or adjusted under 35 U.S.C. 154(b) by 0 days.

(21) Appl. No.: 12/802,533

(22) Filed: Jun. 8, 2010

(65) Prior Publication Data

US 2011/0018196 A1 Jan. 27, 2011

Related U.S. Application Data

(63) Continuation of application No. 12/069,355, filed on Feb. 8, 2008, now abandoned.

(60) Provisional application No. 60/932,453, filed on May 31, 2007, provisional application No. 60/900,795, filed on Feb. 9, 2007.

(51) Int. Cl.
*A63F 3/00* (2006.01)

(52) U.S. Cl. ..... 273/275; 273/153 R

(58) Field of Classification Search ..... 434/188, 434/193, 128; 273/275, 153 R
See application file for complete search history.

(56) References Cited

U.S. PATENT DOCUMENTS

| | | | | |
|---|---|---|---|---|
| 3,267,590 | A * | 8/1966 | Browning | 273/272 |
| 3,633,913 | A * | 1/1972 | Solimene | 273/248 |
| 4,867,455 | A * | 9/1989 | Fritzman | 273/156 |
| 5,149,102 | A * | 9/1992 | McGowan et al. | 273/258 |
| 5,366,226 | A * | 11/1994 | McGowan et al. | 273/258 |
| 5,403,011 | A * | 4/1995 | Schwartz | 273/243 |
| 6,695,618 | B2 * | 2/2004 | Donn | 434/209 |
| 2006/0134588 | A1 * | 6/2006 | Hawley | 434/188 |
| 2007/0138740 | A1 * | 6/2007 | Martineck et al. | 273/138.1 |

* cited by examiner

*Primary Examiner* — Vishu K. Mendiratta
(74) *Attorney, Agent, or Firm* — Malloy & Malloy, P.L.

(57) ABSTRACT

A linking puzzle game and method of play involving one or more players and including a playing surface having at least one, but preferably, a plurality of puzzle areas of varying degrees of difficulty. A plurality of base zones are disposed in an interconnecting relation to one another on each of the one or more puzzle areas, wherein at least one indicia is associated therewith, such as via a plurality of game pieces randomly distributed thereon. A plurality of action pieces each having predetermined indicia disposed thereon which corresponds to an objective goal which is reached by adding or performing another mathematical operation on the indicia of game pieces disposed on appropriate ones of interconnected base zones.

19 Claims, 8 Drawing Sheets

LINKING PUZZLE GAME AND METHOD

CLAIM OF PRIORITY

The present application is a Continuation patent application of previously filed, now pending application having Ser. No. 12/069,355, filed on Feb. 8, 2008, now abandoned which claims priority under 35 U.S.C. Section 119(e) to provisional patent application Ser. No. 60/932,453, having a filing date of May 31, 2007, and provisional patent application Ser. No. 60/900,795 having a filing date of Feb. 9, 2007, each of which are incorporated herein in their entirety by reference.

BACKGROUND OF THE INVENTION

1. Field of the Invention

This invention relates to a linking puzzle game and method of play. The linking puzzle game may include at least one playing surface having at least one or a plurality of puzzle areas disposed thereon. In addition, the linking puzzle game may include a plurality of base zones disposed in a predetermined interconnecting relation, and associated with at least one indicia. For example, a plurality of game pieces having predetermined indicia may be disposed in an at least partially overlying relation with the base zones. Further, the linking puzzle game may also include at least one or a plurality of action pieces each having predetermined indicia disposed thereon corresponding to an objective goal which is reached by adding or performing another mathematical operation on the indicia of game pieces disposed on appropriate ones of interconnected base zones.

2. Description of the Related Art

Playing games and puzzles have been a part of social, mental, and educational development for many years. Several games and puzzles are designed or recommended only for specific age groups. In addition, many games and/or puzzles are strictly designed for educational purposes, entertainment purposes, or competitive purposes.

As such, there is a current need in the art of games and puzzles for a new linking puzzle game and method structured and designed for any and all age groups. Further, the proposed linking game puzzle may be utilized by one or more players at a time for entertainment, educational, health, and/or competitive purposes.

Moreover, the proposed linking puzzle game may improve and/or accentuate an individual's ability to mentally focus and concentrate, whether it be on the particular proposed game itself or in general. The proposed game may further be utilized to promote, improve, and/or advance educational, personal, familial, and/or societal development.

The proposed linking puzzle game may include a playing surface and at least one or a plurality of puzzle areas disposed thereon. The puzzle areas may further include a plurality of interconnected base zones. The base zones may be cooperatively structured such that a plurality of game pieces may be disposed, preferably randomly, in at least partially overlying relation thereto.

Further, the base zones and/or the game pieces of the proposed linking puzzle game may include predetermined indicia disposed thereon, such as numbered indicia. As such, it would be beneficial if the players focused and concentrated on the proposed game and identified certain connected links of game pieces and/or base zones which correspond to a specified objective goal, such as, for example, a summation, multiplication, subtraction, or division value.

SUMMARY OF THE INVENTION

The present invention is related to a linking puzzle game that may be played by one or more players of any and all age groups. Moreover, the linking puzzle game of the present invention may involve great spans of concentration and focus, and in at least one embodiment may typically involve mathematical development. More in particular, the puzzle game of the present invention may develop and/or increase the players' mental ability to quickly and accurately perform mathematical computations.

Moreover, the linking puzzle game of at least one embodiment of the present invention includes a playing surface having at least one or a plurality of puzzle areas disposed thereon. The one or more playing surfaces of at least one embodiment may comprise a game board having a generally flat configuration and be formed of an appropriate durable material. However, the playing surface is not limited to any specific dimensions. For example, the playing surface of the present invention may be at least partially elevated and/or resemble a cone-like configuration. In addition, the playing surface may be constructed of wood, plastic, paper, cardboard, marble, stone, or any other material. It is also contemplated that the linking puzzle game of the present invention be compatible with and/or played on electronic devices such as computers, game consoles, cellular telephones, or any other similar device.

Additionally, in at least one preferred embodiment of the present invention, the puzzle areas include a plurality of base zones disposed in a predetermined interconnecting relation. As such, each of the one or more puzzle areas include a plurality of connectors disposing the plurality of base zones in an interconnecting relation. The connectors may simply include drawn or etched lines, or the connectors may include protruding objects or any other structure operatively interconnecting proximate base zones.

Further, at least one embodiment of the linking puzzle game of the present invention further includes a plurality of game pieces preferably bearing predetermined indicia thereon. In a preferred embodiment, the predetermined indicia on the game, pieces may include numbered indicia, however, many variations may be contemplated, including but not limited to philosophers, musicians, letter, alpha-numeric characters, etc. The game pieces may include a flattened cylindrical structure such as a casino chip. In addition, in the embodiment wherein the linking puzzle game is correspondingly played in a digital and/or electronic environment, the game pieces may simply include digital numbers, digits, words, characters, and/or pictures.

In addition, the linking puzzle game of the present invention may include one, but more practically a plurality of action pieces bearing predetermined indicia thereon. Similar to the game pieces, the action pieces may include an at least partially flattened cylindrical structure, much like a casino chip. Additionally, the action pieces may be any similar structure such as a card, cube, dice, and/or ball or spherical structure. In at least one preferred embodiment, the predetermined indicia on the action pieces include numbered indicia corresponding to an objective goal, as will be described in detail below.

Moreover, at least one preferred embodiment of the present invention further includes at least one or a plurality of operable devices structured to at least partially resemble the puzzle area(s). The operable devices may be written on, and may include, for example, a sheet of paper, cardboard, chalkboard, dry-erase board, or any other similar structure or device. Furthermore, the operable devices may include push buttons or other like devices. Moreover, in at least one embodiment, the operable device(s) are structured and configured to at least partially overlay one or more puzzle areas. In addition, in at least the digital and/or electronic embodiment, the operable device may include a digital rendition or electronic variation of a sheet of paper, cardboard, chalkboard, or dry-erase board as described herein, which as above, may be compatible with and/or used on virtually any computer, game console, cellular telephone, Personal Digital Assistant, etc. More in particular, as will be described in detail below, the operable device(s) may include a digital replica of the puzzle areas designed to allow the player to indicate a connected link thereon. As such, at least in the electronic medium, the operable device(s) may be the playing surface itself whereby the player can highlight, select, mark, or otherwise indicate the connected link directly on the base zones.

Additionally, the present invention includes a method of playing a linking puzzle game. More in particular, at least one preferred method of playing the game includes associating at least one indicia with the base zones, which in at least one embodiment includes orienting a plurality of game pieces into an at least partially overlying relation thereto. In addition, the method may further include the step of selecting or identifying an objective goal, such as a numerical value, and indicating a connected link, which may include game pieces and/or base zones corresponding to the objective goal. More in particular, the objective goal may be, for example, to identify a connected link of game pieces disposed on the puzzle area(s), or indicia associated with the base zones, which add up to a particular numerical value, or are otherwise associated with the selected or identified objective goal. The connected link may include any number of game pieces and/or base zones, and may either be a straight line, a curved or angled line, or any combination thereof.

As above, the linking puzzle game of the present invention may be operated in a digital electronic medium, and thus be played on a computer, game console, cellular telephone, personal digital assistant, etc. In addition, it is contemplated that the linking puzzle game may be played in a game show environment, such as, for example, a television game show.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
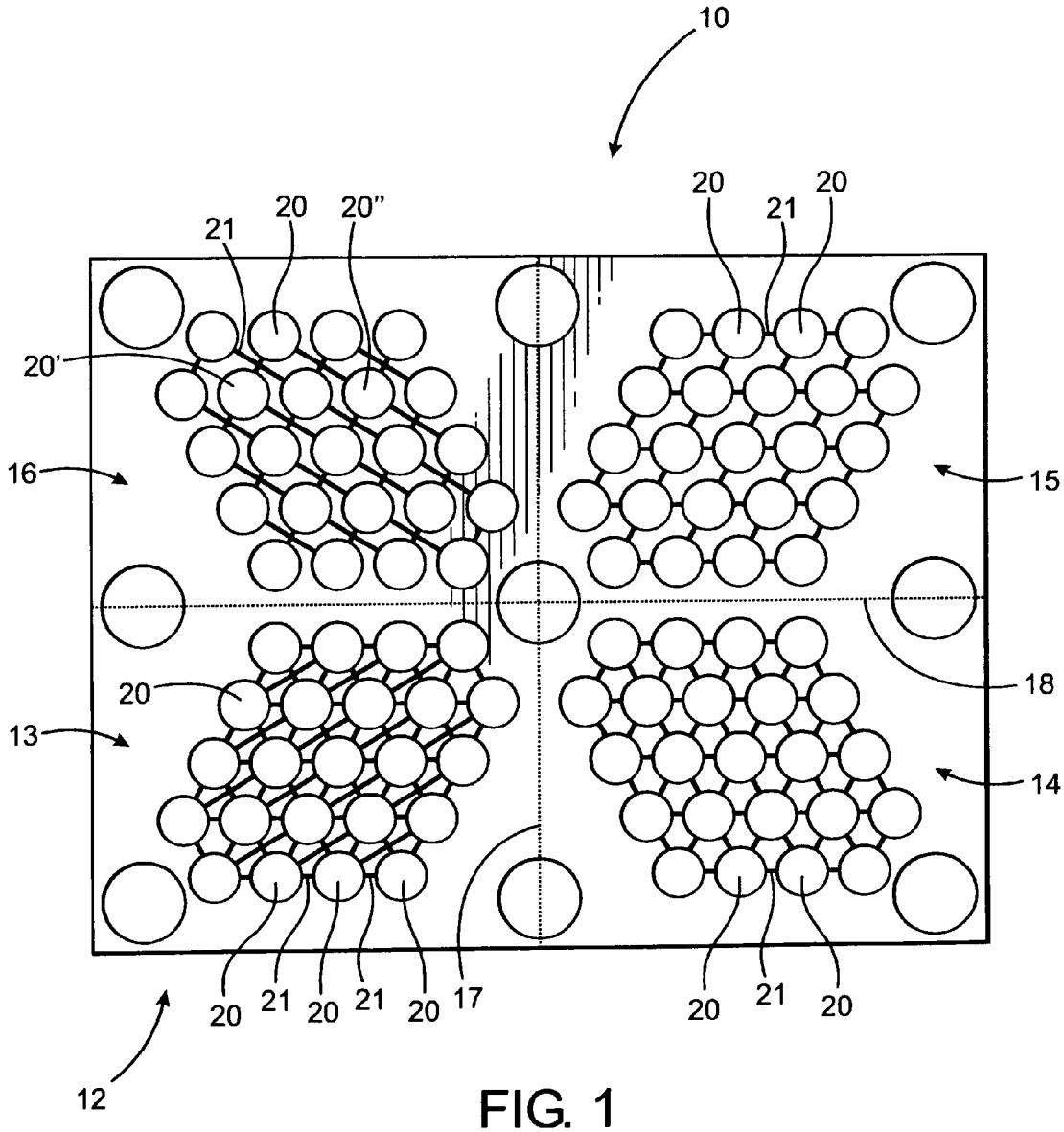
FIG. 1 is a schematic representation of a playing surface of a preferred embodiment of the linking puzzle game of the present invention comprising a plurality of puzzle areas.

As shown in the accompanying drawings, and with primary reference to FIG. 1, the present invention is directed to a linking puzzle game, generally indicated as 10. The linking puzzle game 10 of the present invention may be played by one or more players of any and all age groups. Furthermore, the game 10 may involve focus and concentration, strategy, chance, and mathematical development.

As shown in FIG. 1, at least one embodiment of the present invention may include a playing surface 12 having at least one or a plurality of puzzle area(s) 13, 14, 15, 16 disposed thereon. The playing surface 12 of the present invention may preferably include an at least partially flat and/or durable surface, for example, a game board, and further, the playing surface 12 may comprise virtually any shape, including but not limited to a square, rectangle, circle, oval, etc. In addition, the playing surface 12 of the present invention may be structured and disposed to be at least partially collapsible or foldable, for example, along dotted lines 17 and/or 18, as also illustrated in FIG. 1. As such, the playing surface 12 may be easily stored, collapsible, and/or transported.

However, any shape, configuration, structure and/or durability of the playing surface 12 may be implemented. For example, the playing surface 12 of the linking puzzle game 10 of the present invention may include an at least partially elevated and/or raised configuration. As such, the playing surface 12 may at least partially resemble a cone-like configuration, wherein the center of the board is configured to slightly protrude relative to the outer edges thereof. Moreover, the playing surface 12 may also comprise wood, metal, plastic, a sheet of paper, cardboard, poster board, or other like structure or device. In addition, the playing surface 12 of the present invention, as well as all of the other various structures, devices, and/or elements of the linking puzzle game 10 as described herein, may include a digital and/or electronic configuration, or otherwise be operated in a digital electronic medium. As such, the linking puzzle game 10 of the present invention may be implemented and/or played on a computer, the Internet, cell phone, gaming device, Personal Digital Assistant (PDA), or any other digital or electronic medium or device.

Still referring to FIG. 1, each of the puzzle areas 13, 14, 15, and 16 may be separately disposed and/or designated on the playing surface 12. For example, primarily for ease of reference, each separate puzzle area 13, 14, 15, 16 may be designated by a different season, i.e., summer, winter, fall, or spring. In addition the puzzle areas 13, 14, 15, 16 may be designated by colors, names, years, numbers, dots, shapes, or any other possible designation.

Figure 1A:
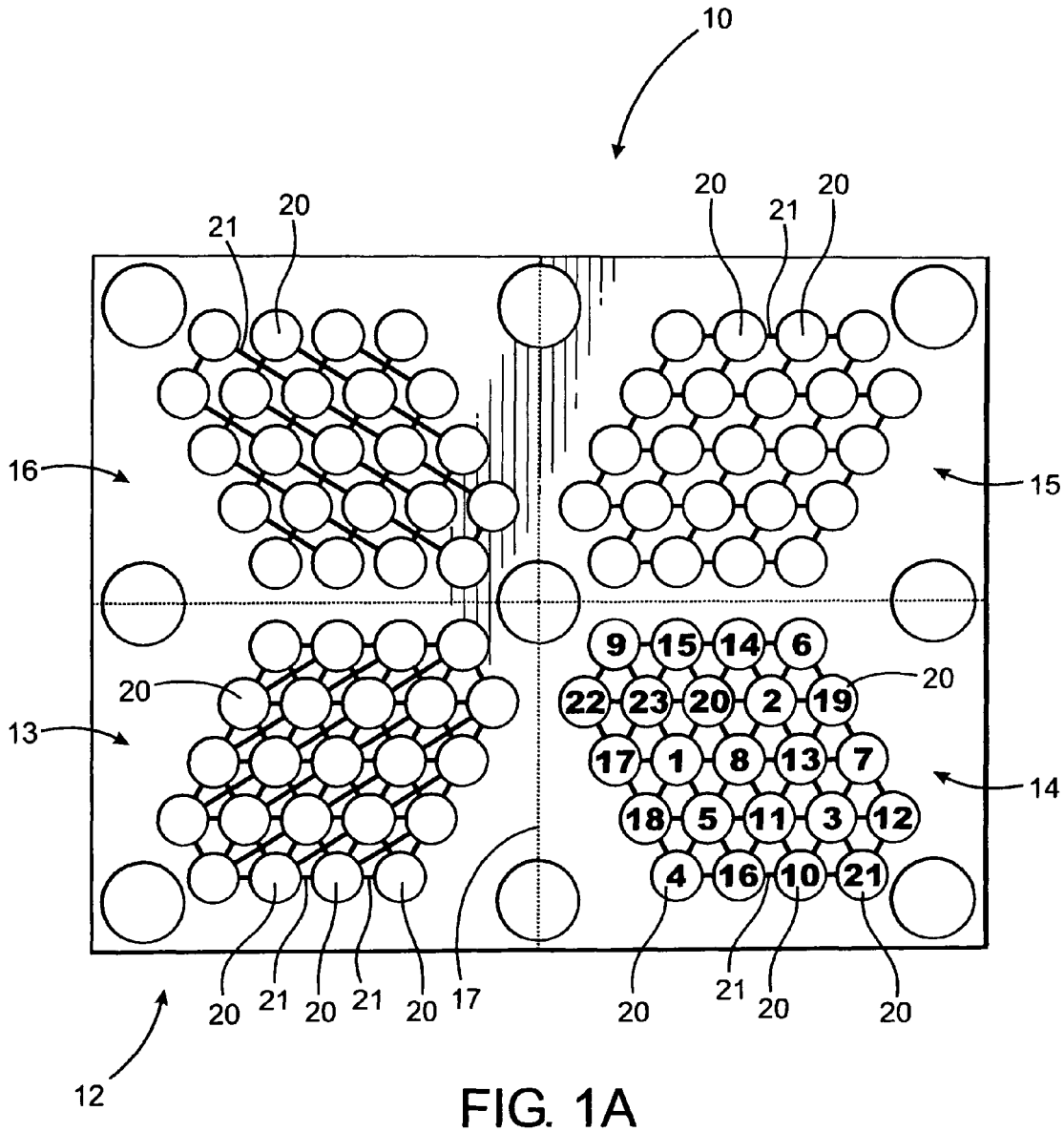
FIG. 1*a* is a schematic representation of a playing surface of at least one embodiment of the present invention.
Figure 1B:
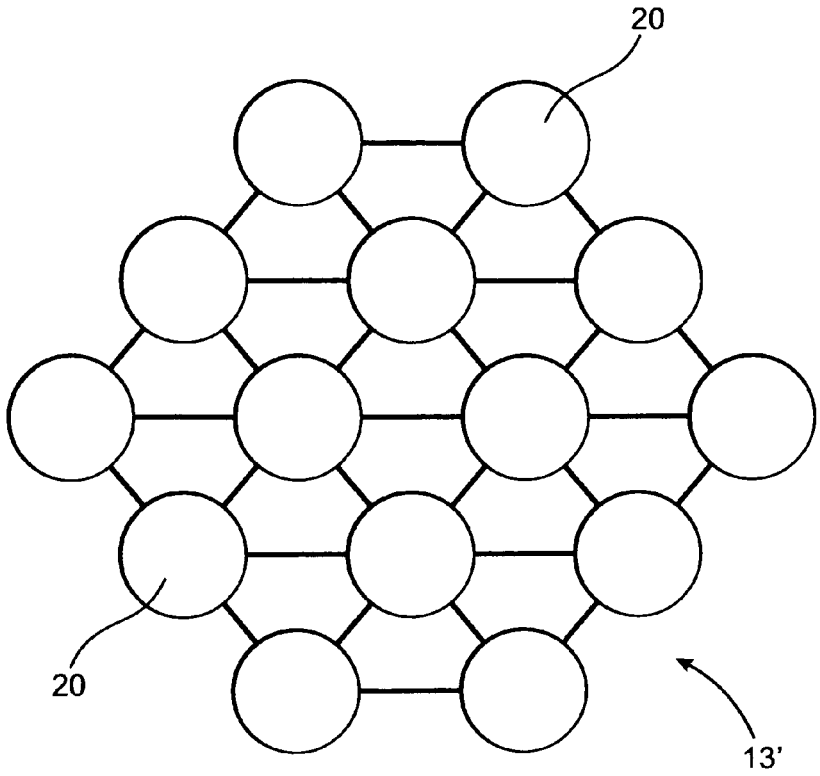
FIG. 1*b* is a schematic representation of at least one embodiment of a puzzle area of the present invention.
Figure 1C:
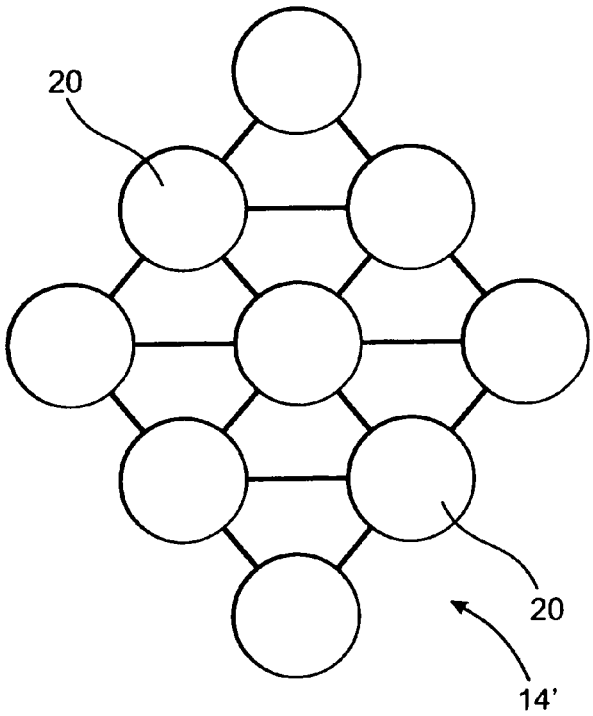
FIG. 1*c* is a schematic representation of yet another embodiment of a puzzle area of the present invention.
Figure 1D:
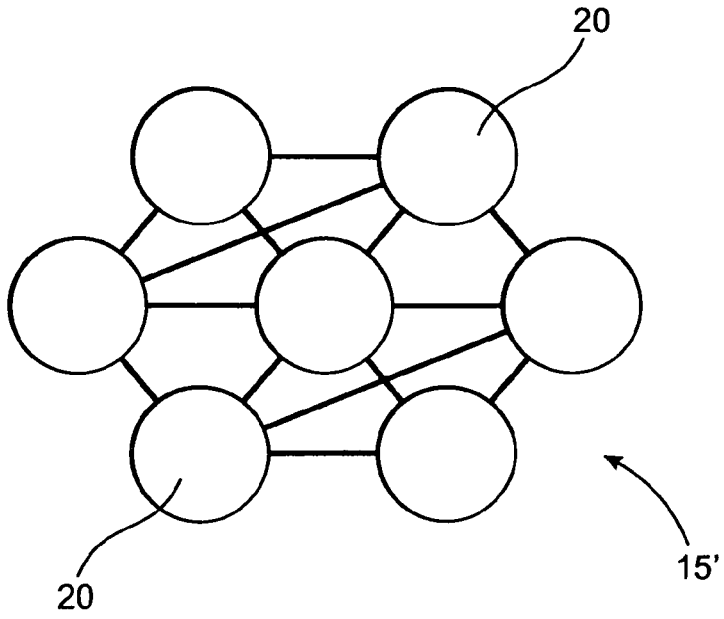
FIG. 1*d* is a schematic representation of another embodiment of a puzzle area as disclosed in the present invention.

Further, each of the puzzle area(s) 13, 14, 15, 16 of the present invention may include any number of a plurality of base zones 20 disposed in an interconnecting relation. In particular, as shown in FIGS. 1 and 1*a*, the puzzle area(s) 13, 14, 15, 16 of at least one embodiment may include twenty-three (23) base zones 20. However, the linking puzzle game of the present invention is in no way limited to such a configuration. As such, the puzzle area(s) 13, 14, 15, 16 of at least one embodiment may include virtually any number of base zones 20. For exemplary purposes only, and as shown in FIG. 1*b*, 1*c*, and 1*d*, the puzzle area(s) 13', 14' and 15' may include fourteen (14), nine (9), and/or seven (7) base zones 20 disposed in an interconnecting relation.

Moreover, each base zone 20 may be disposed in an at least partially interconnecting relation with at least one proximate base zone 20, in virtually any manner, orientation, and/or configuration which facilitates the practice of the present linking puzzle game in the intended fashion. As such, each of the puzzle area(s) 13, 14, 15, 16 may further include a plurality of connectors 21 structured to dispose the base zones 20 in an at least partially interconnecting relation. The connectors 21 may simply comprise drawn lines, curves, or other devices or objects on the puzzle area(s) 13, 14, 15, 16 that are structured to facilitate disposition of proximate base zones 20 into an interconnecting relation. Proximate base zones 20 may, but need not be adjacent. Rather, as best shown in puzzle area 16 of FIG. 1, base zones 20 may be interconnected with proximate base zones 20' and 20". Further, as will be described below, and as shown in puzzle area 14 of FIG. 1*a*, the base zones 20 of the present invention may include predetermined indicia thereon, for example, numbered indicia.

Figure 2:
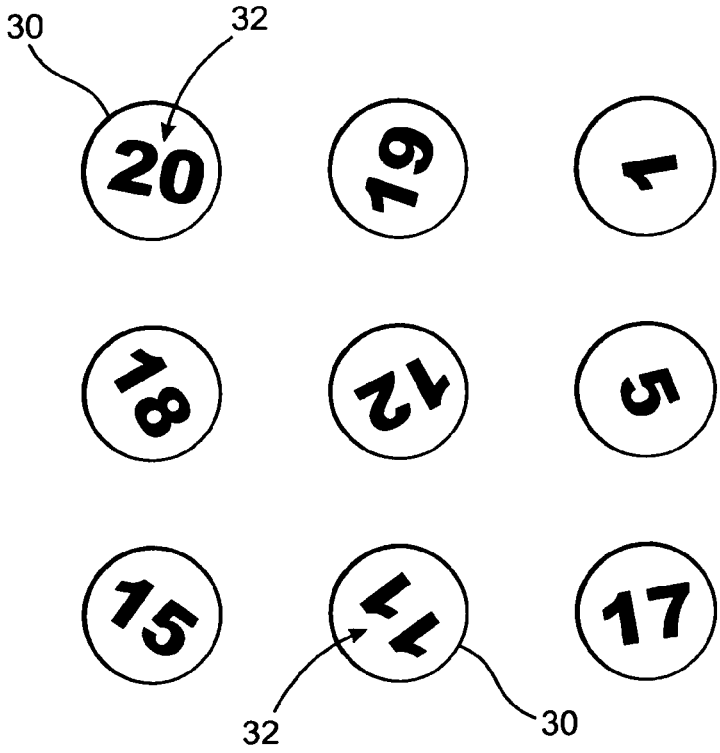
FIG. 2 is a collective representation of a plurality of game pieces of a preferred embodiment of the linking puzzle game of the present invention.

Furthermore, as illustrated in FIG. 2, the linking puzzle game 10 of the present invention may include a plurality of game pieces 30 preferably bearing predetermined indicia thereon. In at least one preferred embodiment of the present invention, the predetermined indicia disposed on the game pieces 30 may be numbered indicia 32, as shown in FIG. 2. However, the predetermined indicia disposed on the game pieces 30 are in no way limited to numbered indicia, and may include, for example, animals, colors, celebrities, eras, geographical structures or areas, etc., or any other indicia structured to facilitate the practice of the present invention in the intended manner.

Moreover, the game pieces 30 of the present invention may comprise any object structured to be disposed in an at least partially overlying relation to the base zones 20 of the puzzle area(s) 13, 14, 15, 16. As such, the game pieces 30 may include an at least partially flattened cylindrical structure similar to a casino chip. However, the game pieces 30 are in no way limited to such structure or configuration. For example, the game pieces 30 may be any shape, including but not limited to, balls, cubes, cones, or any other structure representing a spherical, circular, square, rectangular, pentagonal, octagonal, or any irregular, circular, or multi-sided shape. In addition, the game pieces 30 may comprise any material such as wood, plastic, metal, cardboard, and/or paper.

The linking puzzle game 10 of the present invention may include any number of game pieces 30 bearing any number of or any variation of predetermined indicia thereon. For example, in at least one embodiment of the present invention, the linking puzzle game 10 may include at least twenty-three (23) numbered game pieces 30, preferably sequentially starting at number one (1), and ending at number twenty-three (23). However, any numbering sequence and/or methodology may be implemented which facilitates the practice of the puzzle game of the present invention in the intended fashion. Furthermore, the numbered indicia 32 of the game pieces 30 may be integrated on one or more sides of the game piece 30 of the present invention.

In addition, the base zones 20 and the game pieces 30 may be cooperatively structured to facilitate the game pieces 30 being oriented in an at least partially overlying relation with the base zones 20. As such, the base zones 20 of the present invention may include a substantially flat configuration. Moreover, the base zones 20 of the present invention may simply be designated by a drawing and/or marking on the puzzle area(s) 13, 14, 15, 16. For example, the zone 20 may be a substantially circular configuration designated as a circle physically drawn on the puzzle area(s) 13, 14, 15, 16 of the linking puzzle game 10 of the present invention. In addition, the zone 20 may be designated by a dot, star, or other similar marking. However, the zone 20 is in no way limited to such configuration, and as such, the zone 20 may comprise any shape, configuration, and/or marking. For example, in the embodiment wherein the game pieces 30 comprise balls and/or an at least partially spherical structure, the base zones 20 may comprise cooperatively dimensioned holes and/or indentations in the puzzle area(s) 13, 14, 15, 16.

In addition, the base zones 20 of the present invention may include an at least partially elevated configuration and/or include side walls disposed at least partially around the periphery of the base zone 20. Accordingly, the base zones 20 may receive the game pieces 30 therein to facilitate an at least partially overlying relation therewith.

Figure 3:
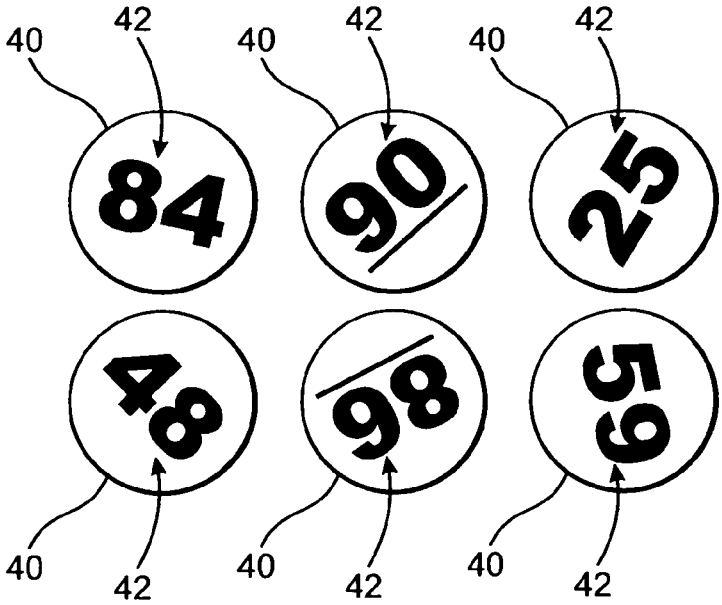
FIG. 3 is a collective representation of a sample of action pieces of a preferred embodiment of the linking puzzle game of the present invention.

Further, in at least one embodiment, the linking puzzle game 10 of the present invention may also include a plurality of action pieces 40 each comprising at least one different predetermined indicia disposed thereon. However, it is contemplated that each different predetermined indicia may be disposed on two or more action pieces 40. As will be described in greater detail below, each of the different predetermined indicia of the action pieces 40 may correspond to an objective goal. For example, as will be described below, in at least one preferred embodiment of the present invention, the predetermined indicia of the action pieces 40 include numbered indicia 42, as represented in FIG. 3. Similar to the game pieces 30, the action pieces 40 may include an at least partially flattened cylindrical structure similar to a casino chip. However, the action pieces 40 may include any device structured to facilitate the practice of the present invention in the intended fashion. For example, the action pieces may include a card, ball, cube, dice, or any other similar structure.

Figure 3A:
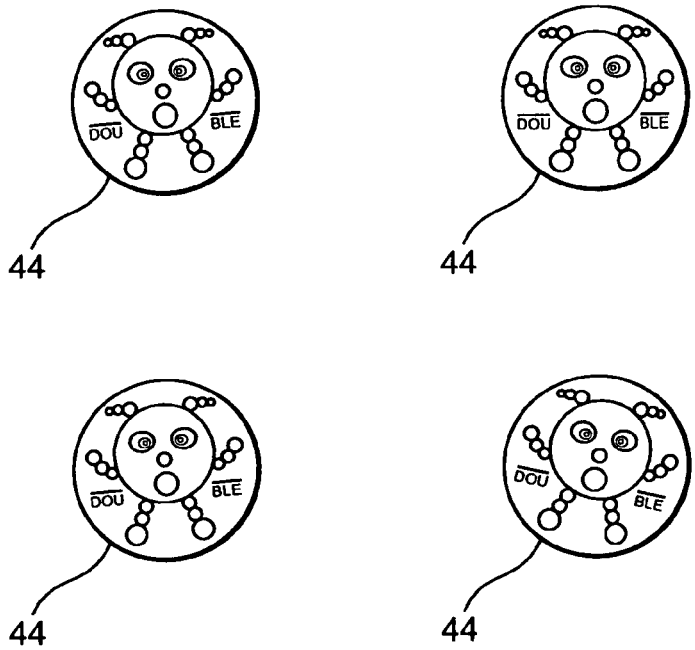
FIG. 3*a* is a collective representation of additional action pieces of another embodiment of the linking puzzle game of the present invention.

In at least one preferred embodiment of the present invention, the linking puzzle game 10 of the present invention may include seventy-six (76) action pieces 40 preferably having numbered indicia 42 sequentially numbered beginning at number twenty-four (24) and ending at the number ninety-nine (99). It should be apparent, however, that the linking puzzle game of the present invention may include virtually any number of action pieces 40, which may depend at least in part upon the number of base zones 20, game pieces 30, and/or the particular indicia associated with the base zones 20. In addition, as shown in FIG. 3*a*, the linking puzzle game of the present invention may further include at least one bonus or wild-card action piece 44. As will be described in further detail below, the bonus or wild-card action piece 44 may represent bonus points, double points, triple points, etc.

Figure 4:
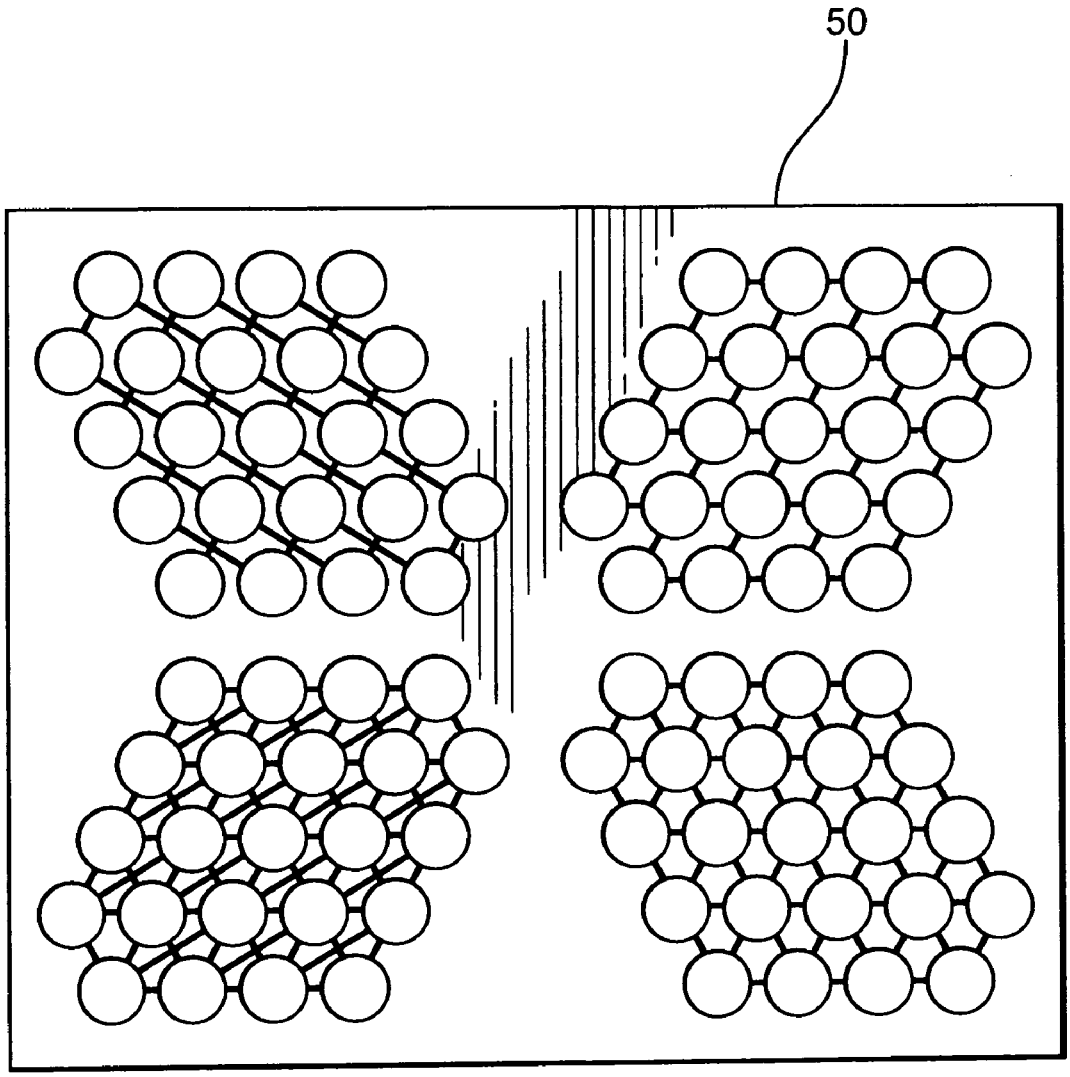
FIG. 4 is a schematic representation of a secondary and/or operable device of at least one embodiment of the linking puzzle game of the present invention.

Referring now to FIG. 4, in at least one preferred embodiment of the present invention, the linking puzzle game 10 may further include at least one or a plurality of secondary and/or operable devices 50. in particular, the secondary and/or operable device(s) 50 may preferably be structured to at least partially resemble the puzzle area(s) 13, 14, 15, 16. Furthermore, the secondary and/or operable devices 50 may be structured to be marked and/or written upon so as to allow a player to indicate a connected link thereon. As such, in at least one embodiment of the present invention, the secondary and/or operable device 50 may include a sheet of paper or cardboard with which any writing utensil can be utilized, including but not limited to a pencil, pen, and/or marker. In addition, however, the secondary and/or operable device 50 may be structured to facilitate multiple, subsequent uses. Accordingly, the secondary and/or operable device 50 may include a chalkboard, dry-erase board, or any other similarly structured surface or device. Furthermore, the secondary and/or operable device 50 may include a device or structure having push buttons that may be pushed in and/or out to indicate the connected link. In at least one embodiment of the present invention, the secondary and/or operable device 50 may include a digital rendition of the puzzle areas 13, 14, 15, 16 that may be highlighted, selected, or otherwise structured to indicate the connected link. Additionally, the secondary and/or operable device 50 may be structured to at least partially overlay the puzzle areas 13, 14, 15, 16, or, at least in the electronic embodiment, be a part of the puzzle areas 13, 14, 15, 16. Accordingly, the puzzle areas 13, 14, 15, 15 themselves may function much like the secondary and/or operable device 50 such that the player may indicate the connected link directly thereon.

Figure 5:
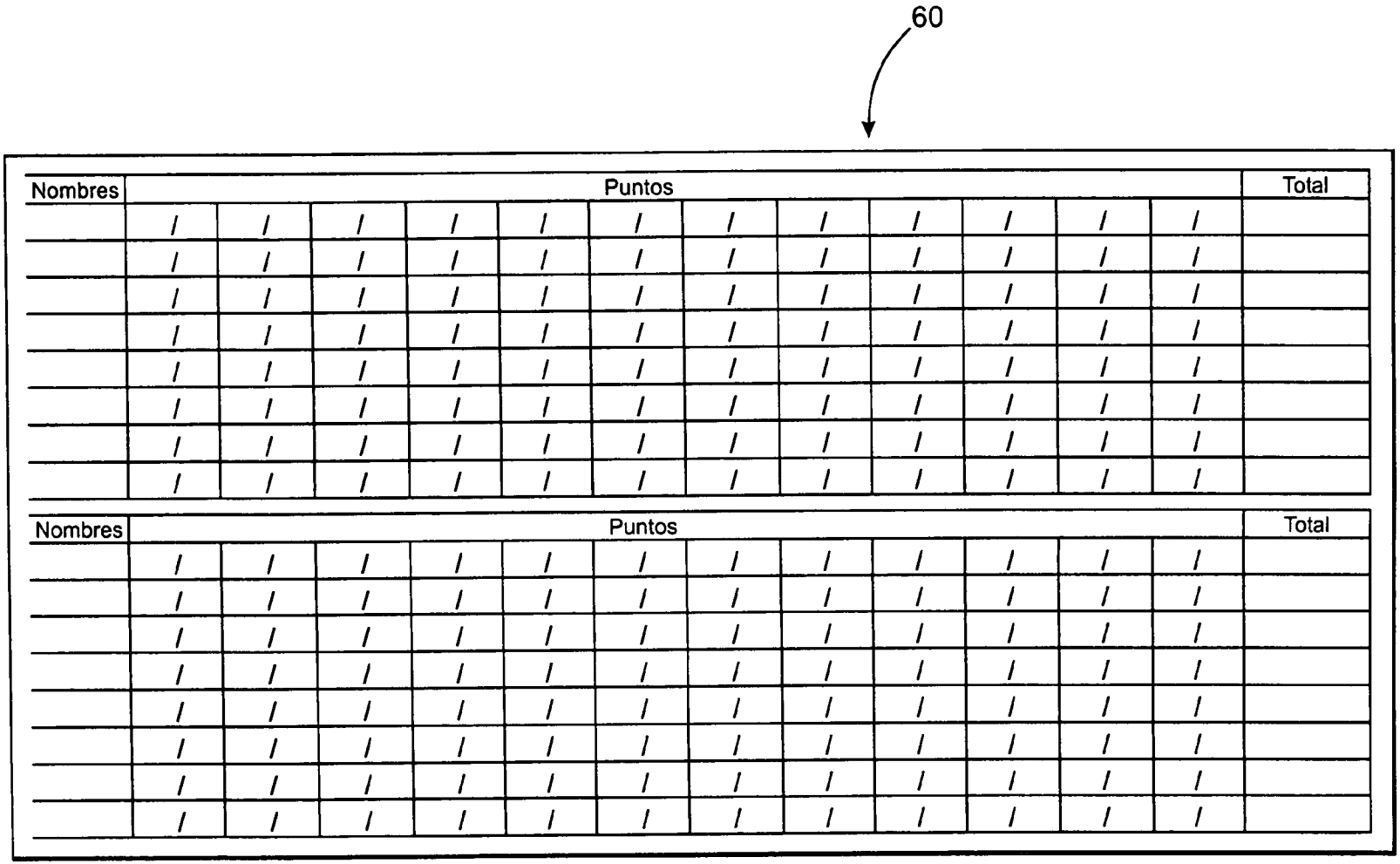
FIG. 5 is a representation of a score sheet of a preferred embodiment of the linking puzzle game of the present invention.

The linking puzzle game 10 of the present invention may also include at least one, but more practically a plurality of score cards 60. Similar to the operable device 50, the score cards 60 may comprise a sheet of paper, card board, chalkboard, dry-erase board, or any other similar surface or device. Further, at least in the digital or electronic embodiment of the present invention, the score card(s) 60 may include an electronic version and may be linked to a database structured to store the scores indicated thereon. Moreover, in at least one embodiment, the scores may be automatically kept or calculated by the computer or other electronic device. An example of a score card 60 is shown in FIG. 5, however, any similar device may be used or implemented to facilitate keeping score of the linking puzzle game 10, as will be described below.

Additionally, at least one embodiment of the linking puzzle game 10 of the present invention may also include a time keeping mechanism. The time keeping mechanism may be a watch, an hourglass (or sand clock), a digital clock, or any other device structured to measure time. The time keeping mechanism may be utilized to calculate or limit the amount of time a player may sit without making a move or identifying a connected link, as will be described below.

The present invention further includes a method of playing the linking puzzle game 10. At least one preferred method of playing the game 10 includes providing at least one playing surface 12 having at least one puzzle area(s) 13, 14, 15, 16 and a plurality of interconnecting base zones 20 disposed thereon. Further, at least one method of playing the game 10 also includes providing each individual player with at least one operable device 50 structured to at least partially resemble the puzzle area(s) 13, 14, 15, 16.

Furthermore, at least one embodiment of the present invention includes associating at least one indicia with the plurality of interconnecting base zones 20. In the embodiment wherein the linking puzzle game is operated in a digital electronic medium, a computer, program, script, etc. may be designed, implemented, or structured to associate at least one indicia with the plurality of interconnecting base zones 20 and display the indicia thereon. It is contemplated that one or more indicia may include blank spaces which may be filled in by the player or at a later time.

Furthermore, associating at least one indicia with the plurality of bases zones of at least one embodiment of the method of playing the game 10 of the present invention includes orienting a plurality of game pieces 30 into an at least partially overlying relation with the base zones 20. In the embodiment wherein the base zones 20 comprise predetermined indicia directly thereon, the step of orienting the game pieces 30 onto the base zones 20 may, but need not, be skipped. For example, if the base zones 20 have predetermined indicia disposed directly thereon, there may be no need to scatter or otherwise dispose the game pieces 30 thereon.

Figure 6A:
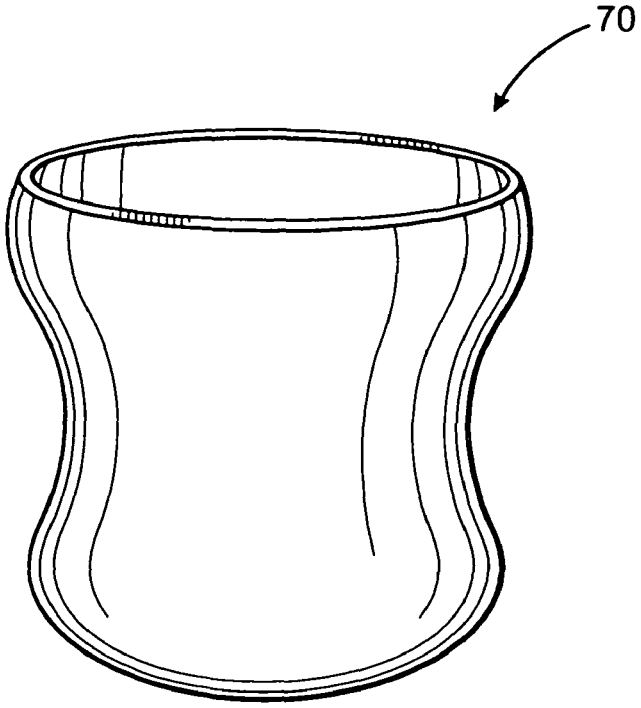
FIG. 6*a* is a schematic representation of a side view of a game piece container of at least one embodiment of the present invention.

The game pieces 30 may be placed into a game piece container, and randomly dispensed, placed, and/or scattered across at least one puzzle area(s) 13, 14, 15, 16. The game piece container may include a cup 70 as shown in FIG. 6*a*. However, any container such as a box, bag, hat, or other similar structure may be utilized. Furthermore, in the electronic version, as indicated above, the computer or other electronic device may dispose digital game pieces 30 over the base zones 20.

As described above, the base zones 20 and the game pieces 30 may be cooperatively structured to facilitate the game pieces 30 to be oriented in an at least partially overlying relation to the base zones 20. As such, at least some or all of the game pieces 30 may inherently assume an overlying relation with the base zones 20. However, the player(s) and/or any individual may maneuver the game pieces 30 into the at least partially overlying relation to the base zones 20. Once the game pieces 30 have been disposed in an initial overlying relation with the base zones 20, preferable randomly as described above, the game pieces 30 may be maintained and/or not moved until play has been stopped and/or terminated.

Further, once the game pieces 30 are operatively disposed in an at least partially overlying relation with the base zones 20, or once the indicia is otherwise associated with the base zone(s) 20, a plurality of connected links may be generated. More in particular, as described above, each base zone 20 may be disposed in an interconnecting relation with at least one other proximate base zone 20. A connected link may comprise any number of operatively disposed or otherwise interconnected game pieces 30 and/or base zones 20. In addition, the connected link may comprise various configurations such as, but not limited to, straight lines, angles, curves, or any combination thereof.

Figure 6B:
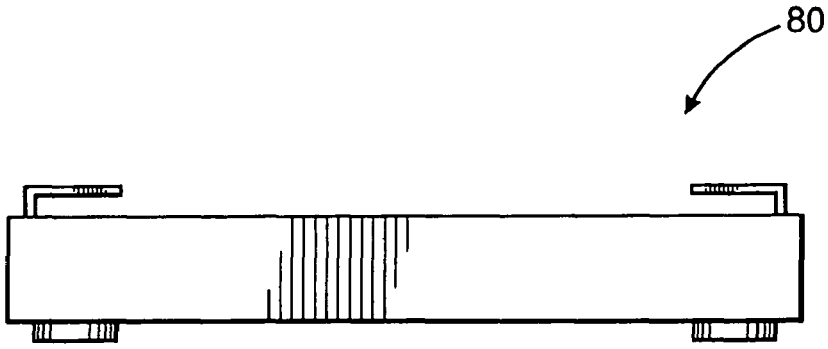
FIG. 6*b* is a schematic representation of a side view of an action piece container of at least one embodiment of the present invention.

At least one preferred method of playing the game 10 of the present invention may further include selecting or identifying an objective goal. In at least one preferred embodiment of the present invention wherein the game pieces 30 and/or the action pieces 40 comprise numbered indicia 32 and 42 respectively disposed thereon, the objective goal may be a numerical value. However, as described above, any indicia may be contemplated. Further, the step of selecting or identifying the objective goal may comprise randomly choosing an action piece 40, for example, from a stack, pile, cup, or action piece container. The action piece container may be any device structured to hold the action pieces 40, and may include a card holder 80 as shown in FIG. 6*b*, a cup 70 as shown in FIG. 6*a*, a bag, a box, or any other device structured to facilitate the practice of the present invention in the intended fashion. In addition, rather than, or in addition to randomly choosing an action piece 40, selecting or identifying an objective goal may include a player and/or computer or other devices deciding or indicating what the particular objective goal should be for each particular game. For example, a player, or any other person whether playing the game or not, may choose, indicate, or identify the objective goal. As such, the player or other person may vocalize the objective goal, write the objective goal down, and/or select the objective goal in any other manner which facilitates the practice of the present invention in the intended manner. The objective goal may be randomly chosen, or at least partially predetermined, for example, based upon a list. In addition, the objective goal may be chosen by a computer or other electronic device, such as, for example, in the embodiment wherein the linking puzzle game of the present invention is operated via a digital electronic medium. The computer or other digital electronic device may indicate or choose the objective goal, for example, randomly, based upon a predetermined algorithm, and/or a list.

Furthermore, at least one method of playing the linking puzzle game 10 of the present invention may include each player separately, independently, and simultaneously identifying and/or indicating a connected link of base zones 20 and/or game pieces 40 corresponding to the objective goal. More in particular, in at least one embodiment of the present invention an object of the game 10 may be to mathematically add the numbered indicia 32 of the game pieces 30 disposed in a corresponding connected link. Furthermore, it may also be an object of the game 10 such that the total sum in the identified connected link must equal the objective goal. Accordingly, and as identified above, in at least one embodiment, once the game pieces 30 are initially operatively disposed in overlying relation with the base zones 20, and/or once the indicia is associated with the base zones 20, the game pieces 30 or indicia may not be moved until play has terminated. As such, the one or more players may concentrate and/or focus on the operatively disposed game pieces 30, and the particular interconnecting relation in which the game pieces 30 may be oriented.

In addition, at least one method of playing the linking puzzle game 10 of the present invention may further include indicating the connected link on the operable device 50. As described above, the operable device may preferably be structured to resemble the puzzle area(s) 13, 14, 15, 16 of the present invention. In particular, the connected link may be indicated on the operable device 50 via corresponding check marks, "X" marks, or virtually any other marking(s). In at least the digital electronic embodiment, the connected link may be indicated by clicking on or otherwise manipulating the operable device 50, the base zones 20, and/or any other structure, device, or mechanism which facilitates the practice of the present invention in the intended fashion.

Furthermore, in at least one embodiment of the present invention, and in particular wherein the puzzle game is operated in a digital electronic medium, the player may indicate a connected link in various manners, including but not limited to, clicking on the base zone(s) 20 themselves. It is contemplated that such an embodiment further includes various audio, visual and/or other special effects. For example, the indicia, base zones 20, or any other portion of the present invention may dim, flash, blink, change colors, darken, disappear, etc. upon the occurrence of a predetermined event such as by clicking on or hovering a pointing device over the indicia or base zone(s) 20, and/or during any predetermined or random intervals.

It is possible that the indicia and/or game pieces 30 of at least one embodiment of the present invention may not present a configuration on the interconnected base zones 20 which correspond to the selected or identified objective goal. For example, in the embodiment wherein the indicia associated with the base zones 20 are numbered indicia, and the objective goal is thus a number, which in one embodiment requires indicia associated with interconnected base zones 20 to be added together to reach the objective goal, it is possible that the interconnected base zones 20 on one or more of the puzzle areas 13, 14, 15, 16 do not represent any connected links which correspond to or otherwise add up to the objective goal. In such an instance, at least one method of play represented by the present specification includes a player indicating that there are no possible connected links which correspond to the objective goal. In addition, the first player to indicate such a configuration, once verified by other players, and/or the program or other software, will have points added to their score. In one embodiment, the player will have double points or other bonus points added to their score for indicating such a configuration.

Once a player has indicated the identified connected link, such as, for example on the operable device 50, at least one method of playing the game 10 of the present invention may include vocalizing, expressing, and/or representing a predetermined terminating expression. More in particular, before beginning the game, the players may agree on a term or expression which will terminate the game play. The predetermined terminating expression may be any word or phrase, such as "Stop", "I got it", or the name of the game. In addition the predetermined terminating expression may further include pushing and/or clicking a button, making a gesture, or any other similar expression or action. If two or more players simultaneously express the predetermined terminating expression, the players must identify which player should be rewarded. For example, when two or more players simultaneously express the terminating expression, the player with the fewest points may be benefited. In addition, the remaining players may verify which player expressed the terminating expression first.

After a player expresses the predetermined terminating expression, each player may stop and verify the connected link represented for example on the player's operable device 50. If the identified connected link correctly corresponds to the previously identified objective goal, the player may be rewarded. As such, points may be added to the player's score, for example, by designating points on the player's respective score card 60, or the player's designated row, column, or area on the score card 60. The player may be rewarded by the number of points that correspond to the objective goal. However it is also contemplated that there may be a designated amount of points, for example 50 points, for each correct connected link.

Furthermore, as described above, the present invention may include at least one bonus or wild card action piece 44. In the event a bonus or wild-card action piece 44 is chosen randomly or by a player, for example, during the step of selecting an objective goal, then the bonus or wild-card action piece 44 may be used to supplement a player's score or total points. For example, if a multiplier bonus or wild-card action piece 44 is chosen, such as one designated "double", "triple", etc., then the player's points accumulated during that round will be so modified. In addition, a bonus or wild-card action piece 44 may be designated as additional bonus points, for example, 50 points, 75 points, 100 points, etc. If such an action piece 44 is chosen randomly or by a player, then the winning player's score will be adjusted by the designated amount.

In addition, a player's score, or total points, may be negatively impacted or reduced, for improper play. For example, improper play may include vocalizing, expressing, and/or representing a non-designated expression in an attempt to end or stop play. More in particular, if the predetermined terminating expression is vocalizing the word "Stop", then any other word, phrase, or expression is a non-designated expression. Further, improper play may also include identifying a deficient link. A deficient link may include a link of game pieces 30 or base zones 20 that do not correspond to the objective goal and/or that are not operatively interconnected by the connectors 21.

Furthermore, once the connected link has been verified and/or the player's scores correspondingly modified as just described, at least one preferred method of playing the linking game 10 of the present invention may include repeating the steps with successive rounds of play until a player reaches a predetermined score, for example 400 points, or −200 points. In addition, in the event the playing surface 12 of the present invention includes a plurality of puzzle area(s) 13, 14, 15, 16, each successive round of play may take place on successive puzzle area(s) 13, 14, 15, 16. More in particular, as described above, the playing surface 12 may include a plurality of puzzle area(s) 13, 14, 15, 16 each having base zones 20 disposed in a uniquely interconnected relation, as shown in FIG. 1. For example, the base zones 20 of puzzle area 13 are disposed in a separate and unique interconnecting relation than the base zones 20 of the other puzzle areas 14, 15, and 16.

In addition, the puzzle area(s) 13, 14, 15, 16 may be disposed in a predetermined orientation progressively increasing in difficulty. For example, the interconnecting relation of the base zones 20 may at least partially dictate the difficulty of the puzzle area(s) 13, 14, 15, 16. More in particular, as the number of connectors 21 decreases relative to the number of base zones 20, the number of connected links also decreases. As such, the relative level of difficulty may increase. Thus, each successive round of play requires great concentration and focus on the unique qualities of the respective puzzle area(s) 13, 14, 15, 16.

In at least one alternative method of playing the linking puzzle game 10 of the present invention, the action pieces 40 may be divided into groups corresponding to the number of puzzle areas 13, 14, 15, 16 that are disposed on the playing surface 12. For example, as shown in FIG. 1, in at least one embodiment of the present invention, the playing surface 12 may comprise four puzzle areas 13, 14, 15, and 16. As such, the action pieces may be divided into four separate groups or piles. In such an alternate embodiment, each separate group of action pieces 40 will be designated to one puzzle area 13, 14, 15, 16.

In at least another alternate method of playing the linking puzzle game 10 of the present invention, rather than randomly selecting an objective goal from the action pieces 40, the player or players may provide the objective goal. Additionally, in the event the linking puzzle game 10 includes a plurality of puzzle areas 13, 14, 15, 16, rather than rotating between the puzzle areas 13, 14, 15, 15 in a predetermined fashion, the player or players may designate which puzzle areas 13, 14, 15, 16 to play on.

In addition, in yet another alternate method of playing the linking puzzle game 10 of the present invention, the puzzle game 10 may include a plurality of sets of game pieces 30 and actions pieces 40. The sets may be identical or different. In the event there are a plurality of players, each player may have their own set of game pieces 30 and/or action pieces 40. Accordingly, each player will simultaneously try to identify connected links on their own separate puzzle area 13, 14, 15, 16.

Moreover, another method of playing the game of the present invention includes indicating a plurality of connected links; wherein the plurality of connected links collectively correspond to the objective goal. In particular, in the embodiment wherein the indicia are numbered indicia, and the objective goal is a number such that interconnected base zones 20 and/or associated indicia are to be added together to correspond to the objective goal, one method of play allows or requires a player to indicate a plurality of connected links which collectively add up to or otherwise correspond with the objective goal. The plurality of connected links may be indicated on one, a plurality of, different, and/or successive puzzle areas 13, 14, 15, 16. For exemplary purposes only, the objective goal may include two hundred ninety-three (293). In such an instance, a player may indicate four (4) separate and independent connected links which add up to or otherwise correspond to the numbers eighty-eight (88), seventy-one (71), ninety-nine (99), and thirty-five (35), which collectively add up to or otherwise correspond to the objective goal, which in this illustrative example is two hundred ninety-three (293). The connected links may be indicated on one or more puzzle areas 13, 14, 15, 16.

Furthermore, yet one other alternate method of playing the linking puzzle game of the present invention includes initially suppressing the at least one indicia associated with one or more of the base zone(s). In particular, the indicia may be initially suppressed, hidden, or shielded by covering it up with an object, such as a removable flap, or covering the indicia with any removable structure or surface which may be easily scratched off or otherwise removed so as to reveal the indicia thereunder. Furthermore, suppressing the at least one indicia may include a blank base zone 20, which may be filled in or otherwise associated with an indicia at a later time. In addition, at least in one embodiment wherein the linking puzzle game is operated in a digital electronic medium, the indicia may be initially suppressed in virtually any manner facilitated by software or other programs or scripts. Furthermore, at least one embodiment of the method of the present invention may include selectively revealing the indicia. This may include removing a flap or other object, scratching off a removable surface, and/or a player filling in or vocalizing indicia to be associated with a base zone 20. As such, one or more players may selectively reveal the indicia either in alternating, or rotating turns, or in a lottery-style environment wherein the indicia are randomly revealed.

In addition, another method of playing the linking puzzle game of the present invention includes players taking turns, one-by-one in an alternating and/or rotating fashion wherein each player indicates, marks, or otherwise chooses one or more base zone(s) 20, for example, via an operative device 50 or directly on the base zone(s) 20, game piece(s) 30, or playing surface 12. In particular, the player may mark the base zone(s) 20, operative device(s) 50, etc. with an "X", a check mark, a dot, a playing piece unique to each individual player, and/or any other mark(s). Further, at least in the digital electronic embodiment, each player may be associated with a unique color, symbol, or other marking which is used to indicate the chosen base zone(s) 20, game piece(s) 30, or indicia. The player who completes the connected link which corresponds to the objective goal shall will the round, game, or otherwise have points added to its collective score. Based at least in part upon the alternating and/or rotating turns, this particular style and/or method of play is typically slower than at least one of the other embodiments described above.

Furthermore, the linking puzzle game of at least one embodiment of the present invention may be played in a game show environment, such as a television or other broadcasted game show. Accordingly, the linking puzzle game of the present invention may be played by one or more individuals or groups of individuals in a game show environment or playing style. The game show environment may, but need not, utilize a digital electronic medium to display the playing surface, puzzle areas, base zones, objective goal, etc. Of course, at least one embodiment includes audio, visual, and other special effects to illustrate connected links, active puzzle areas, objective goals, correct/incorrect connected links, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. For example, while the foregoing primarily refers to mathematical operations, the present invention could also be adapted for play by connecting links of artists, musicians, philosophers, movies, etc.

Now that the invention has been described,

What is claimed is:

1. A linking puzzle game comprising:

a single playing surface, and a separate corresponding secondary device, said single playing surface comprising a plurality of separate, spaced apart and independently playable puzzle areas disposed thereon, each of said plurality of puzzle areas comprising a plurality of base zones and a plurality of connectors disposed therebetween, said plurality of base zones being disposed in an interconnecting relation with one another via said connectors, each of said plurality of puzzle areas of said single playing surface comprises a common number of base zones and a different number of connectors, a plurality of game pieces, each of said plurality of game pieces comprising predetermined numbered indicia disposed thereon, said plurality of game pieces disposed in an at least partially overlying relation with each and every one of said plurality of base zones of a common one of said plurality of separate, spaced apart and independently playable puzzle areas, wherein each and every one of said plurality of base zones of a common one of said plurality of separate, spaced apart and independently playable puzzle areas comprises a different one of said plurality of game pieces disposed thereon, a plurality of action pieces bearing predetermined numbered indicia disposed thereon, said predetermined numbered indicia disposed on said plurality of action pieces corresponding to an objective goal, wherein said objective goal is obtained via a connected link of said game pieces disposed on said plurality of base zones corresponding to said objective goal, and said secondary device comprising a plurality of secondary puzzle areas disposed thereon, each of said plurality of secondary puzzle areas of said secondary device comprising a plurality of secondary base zones, said secondary base zones disposed in an identical interconnecting relation with one another relative to said interconnected relation of said plurality of base zones of a corresponding one of said plurality of separate, spaced apart and independently playable puzzle areas of said playing surface, said secondary device being separate from said playing surface and said puzzle areas, wherein said secondary device is structured to allow a player to draw a continuous line directly thereon in order to identify a connected link of said game pieces disposed on said plurality of base zones corresponding to said objective goal.

2. The linking puzzle game recited in claim 1 wherein said plurality of base zones and said plurality of game pieces are cooperatively structured to facilitate said plurality of game pieces to be disposed in an at least partially overlying relation with said plurality of base zones.

3. The linking puzzle game recited in claim 2 wherein said objective goal is a numerical value.

4. The linking puzzle game recited in claim 3 wherein said predetermined indicia on said game pieces represent numerical values 1 through 23.

5. The linking puzzle game recited in claim 4 wherein said predetermined indicia disposed on said action pieces represent numerical values 24 through 99.

6. The linking puzzle game recited in claim 1 wherein said predetermined indicia on said game pieces comprises numbered indicia.

7. The linking puzzle game recited in claim 1 wherein said plurality of puzzle areas are disposed in a predetermined orientation progressively increasing in difficulty.

8. The linking puzzle game recited in claim 1 wherein said plurality of base zones of each of said plurality of puzzle areas are disposed in a uniquely oriented predetermined interconnecting relation.

9. The linking puzzle game recited in claim 1 further comprising a plurality of connectors disposed in an interconnecting relation between each of said plurality of base zones and a corresponding one of said connected base zones.

10. The linking puzzle game recited in claim 9 wherein each of said plurality of base zones are disposed in an interconnected relation to at least two of said connected base zones.

11. The linking puzzle game recited in claim 9 wherein each of said plurality of base zones are disposed in an interconnected relation to at least three of said connected base zones.

12. The linking puzzle game recited in claim 1 further comprising a time keeping mechanism.

13. The linking puzzle game recited in claim 1 further comprising a game piece container structured to operatively hold said plurality of game pieces.

14. The linking puzzle game recited in claim 13 wherein said game piece container is a cup.

15. The linking puzzle game recited in claim 1 further comprising an action piece container structured to operatively hold said action pieces.

16. The linking puzzle game recited in claim 15 wherein said action piece container is a card holder.

17. The linking puzzle game recited in claim 1 wherein each of said plurality of base zones is initially paired with one of said plurality of game pieces.

18. The linking puzzle game as recited in claim 1 wherein said single playing surface comprises four separate, spaced apart and independently playable puzzle areas.

19. The linking puzzle game as recited in claim 18 wherein each of said four separate, spaced apart and independently playable puzzle areas of said single playing surface comprise twenty three base zones.

* * * * *